US006470785B2

(12) United States Patent
Heldmann

(10) Patent No.: US 6,470,785 B2
(45) Date of Patent: Oct. 29, 2002

(54) DEVICE FOR FORWARDING LARGE-CALIBER SHELLS TO A HEAVY WEAPON, ESPECIALLY IN AN ARMORED HOWITZER

(75) Inventor: Heinrich Heldmann, Kassel (DE)

(73) Assignee: Krauss-Maffei Wegmann GmbH & Co. KG, Kassel (DE)

( * ) Notice: Subject to any disclaimer, the term of this patent is extended or adjusted under 35 U.S.C. 154(b) by 0 days.

(21) Appl. No.: 09/880,553

(22) Filed: Jun. 13, 2001

(65) Prior Publication Data

US 2002/0029687 A1 Mar. 14, 2002

(30) Foreign Application Priority Data

Jun. 15, 2000 (DE) ..... 100 29 477

(51) Int. Cl.[7] ..... F41A 9/38
(52) U.S. Cl. ..... 89/46
(58) Field of Search ..... 89/46

(56) References Cited

U.S. PATENT DOCUMENTS 4,398,447 A * 8/1983 Harris et al.
4,481,862 A * 11/1984 Wiethoff et al.
4,759,254 A * 7/1988 Zielinski et al.
4,898,072 A * 2/1990 Gropp
4,947,728 A * 8/1990 Muhlhausen et al.
5,054,367 A * 10/1991 Heldmann et al.
5,131,316 A * 7/1992 Lawrence
5,223,663 A * 6/1993 Bender-Zanoni et al.
5,440,966 A * 8/1995 Tellander et al.
5,675,109 A * 10/1997 Maher
5,837,922 A * 11/1998 Maher et al.
5,965,837 A * 10/1999 Lee et al.

FOREIGN PATENT DOCUMENTS

DE 626453 * 2/1936
FR 675750 * 11/1929
GB 14001 * 11/1916

* cited by examiner

*Primary Examiner*—Michael J. Carone
*Assistant Examiner*—Troy Chambers
(74) *Attorney, Agent, or Firm*—Chadbourne & Parke, LLP

(57) ABSTRACT

The device for forwarding large-caliber shells to a heavy weapon, especially in an armored howitzer, wherein the shells are laid in a readiness tray that can be displaced horizontally along a forwarding path and the mechanism on the readiness tray axially brakes and fixes any shell laid therein. A shell support supports the shell in the vicinity of its ogive. The shell support is mounted on a supporting-lever rod in the form of an articulated-lever system that can be lowered against the force of a spring. The system's descent can be blocked by a locking mechanism. The blocking mechanism is provided with a pawl at one end of the system's second supporting lever. The pawl engages a notched rod that can be raised and lowered. The upward and downward motions of the rod are controlled by a skate that travels over a control strip while the tray is being displaced. The strip is positioned stationary below the tray.

7 Claims, 5 Drawing Sheets

DEVICE FOR FORWARDING LARGE-CALIBER SHELLS TO A HEAVY WEAPON, ESPECIALLY IN AN ARMORED HOWITZER

FIELD OF THE INVENTION

The present invention concerns a device for forwarding large-caliber shells to a heavy weapon, especially in an armored howitzer, whereby the shells are laid in a readiness tray by a shell transporter provided with a shell grip, whereby the readiness tray can be displaced horizontally along a forwarding path and pivoted up around a horizontal axis at the end of the path into an essentially vertical attitude, and whereby the shell is transferred from the readiness tray to a loading tray positioned on the free end of a shell-release arm that pivots around the weapon's trunnions.

A general device of this genus, for use in an armored howitzer, is in itself known and is described for example in European Patent 0331980B1. There are, however, several drawbacks to this device. The shell, when the transporter lays it in the readiness tray, tends to slide forward due to the momentum imparted to it in the readiness tray. This tendency is especially detrimental when a non-contacting fuze adjuster for large-caliber shells is mounted at the end of the readiness tray farther forward in the direction the shell is laid in. Such a fuze adjuster is specified for example in the as yet unpublished German 19901673 A1. The fuze trimmer can be damaged. Attempts have been made to eliminate this drawback by positioning a stop in the readiness tray. A band around the rear of the shell accordingly comes to rest against the stop when the shell slides forward in the readiness tray. It turns out, however, that shells with a well advanced center of gravity will tilt slightly forward as they travel, and the rear of the shell will accordingly rise along with the band around it. The band can then slip beyond the stop.

SUMMARY OF THE INVENTION

One object of the present invention is accordingly to improve the generic device to the extent that the shell will be effectively prevented from sliding forward when it is laid in the readiness tray. The device is intended to be independent of the size and shape of the shell.

This object is attained in accordance with the present invention by a mechanism on the readiness tray that axially brakes and fixes any shell laid therein and by a shell support at the end of the readiness tray associated with the point of the shell that supports the shell therein in the vicinity of its ogive, whereby the shell support is mounted on a supporting-lever rod that can be lowered against the force of a spring, its descent being blocked by a blocking mechanism during a prescribed length of the readiness tray's travel along its forwarding path.

The device in accordance with the present invention is designed to prevent the shell from both sliding and tilting forward by supporting and fixing it in the vicinity of the ogive. The supporting-lever rod and blocking mechanism can preferably comprise an articulated-lever system, allowing the shell to be supported and fixed in the readiness tray in accordance with the motion of the loading tray. As will be specified by way of example hereinafter with respect to one embodiment of the present invention, the shell support can be released as the readiness tray begins to move and can accordingly automatically adapt itself to the size and shape of the shell. The shell support will then be blocked as the readiness tray continues to travel, and the shell will be secured in the tray without sliding forward. When the readiness tray stops moving, however, the shell support will be released again, and the front of the shell will be able to travel unimpeded from the programming station to the non-contacting fuze adjuster.

It has also been shown practical and useful, in accordance with the current invention, to provide the readiness tray with, in addition to and independent of the mechanism that brakes and fixes the shell while the readiness tray is horizontal, a mechanism for radially maintaining the shell in the readiness tray as the latter pivots up. This mechanism prevents the shell from tilting out of the readiness tray as the tray pivots up.

These and other objectives, characteristic and advantages of the present invention will be disclosed in more detail with reference to the attached drawings.

DETAILED DESCRIPTION OF THE INVENTION

Only those parts of the device for forwarding large-caliber shells to the heavy weapon in an armored howitzer that relate to laying and securing the shells in the readiness tray will be specified and illustrated hereinafter. These parts can be components of an ammunition-supply system in an armored howitzer like that specified in European Patent 0331980B1 for example. A non-contacting fuze adjuster for large-caliber shells, as for example of the type specified in the German 19-901673 A1, can also be mounted on the readiness tray. The shells are laid in a readiness tray 1 by an unillustrated shell transporter provided with a shell grip. Readiness tray 1 can be displaced horizontally along a forwarding path and pivoted up around a horizontal axis S at the rear end of the path into an essentially vertical attitude.

Shells of different length and shape can be laid in readiness tray 1. A shell GS of one such form is depicted by continuous lines in the figures, and shells of other forms by discontinuous or dot-and-dash lines.

The forwarding path is represented only by its baseplate 2, further forwarding means comprising unillustrated lateral rails.

Figure 1:
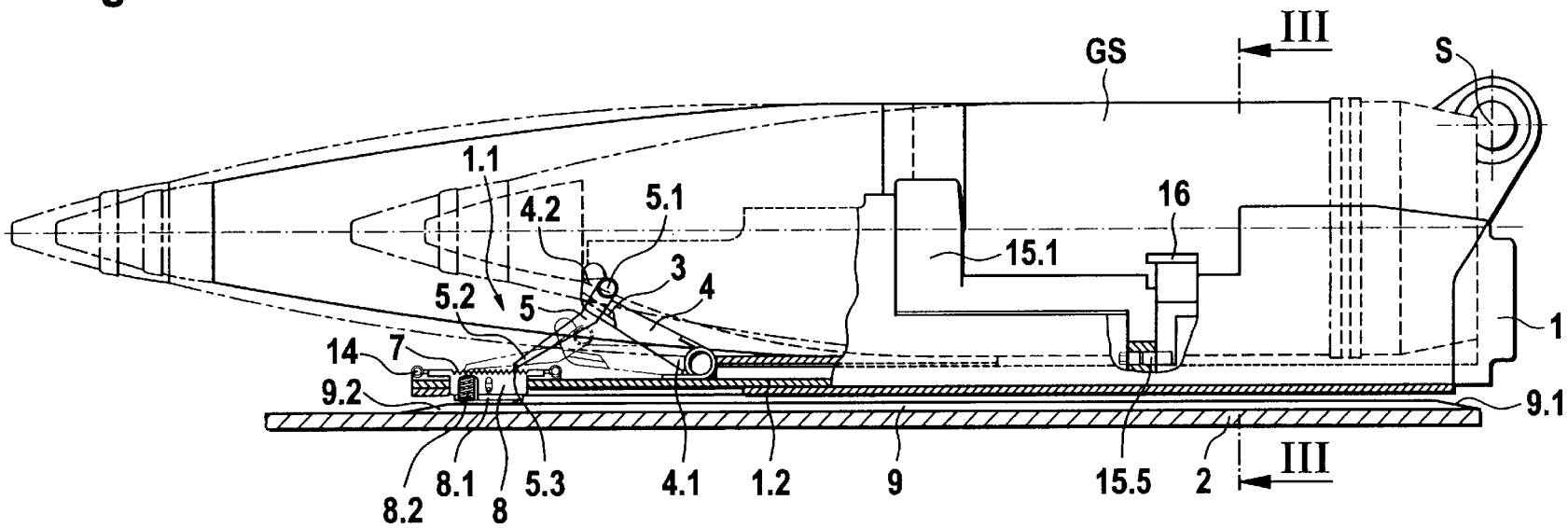
FIG. 1 is a partly sectional lateral view of a readiness tray with a shell laid in it and just before discontinuing its forward motion.
Figure 2:
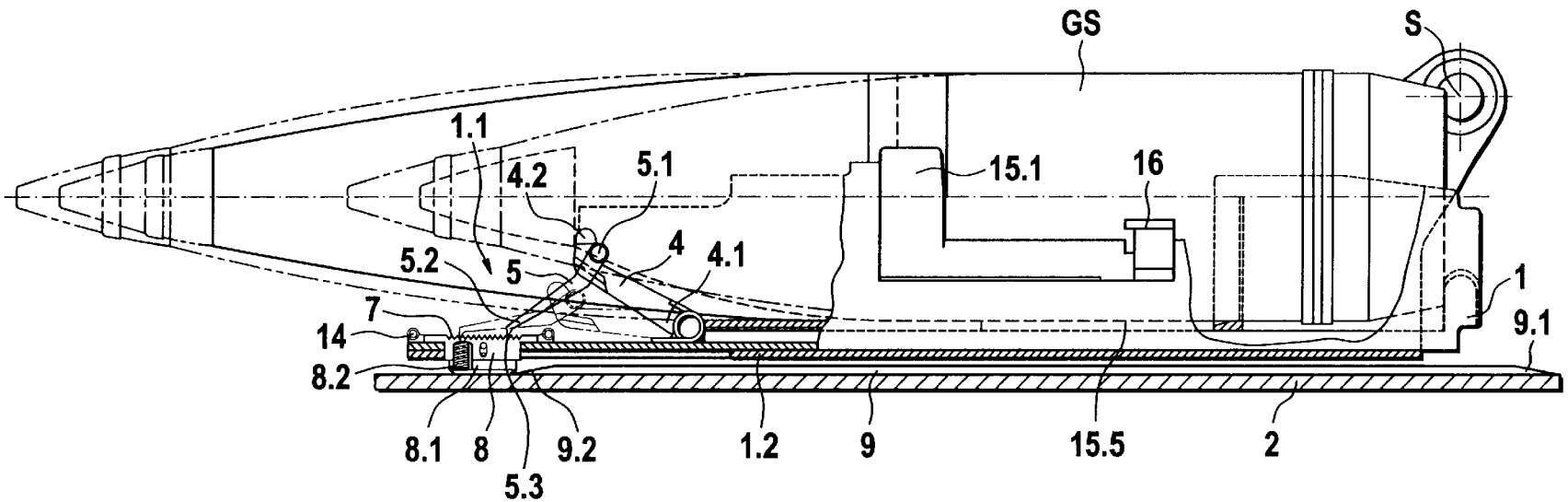
FIG. 2 illustrates the readiness tray illustrated in FIG. 1 once it has stopped traveling.
Figure 4:
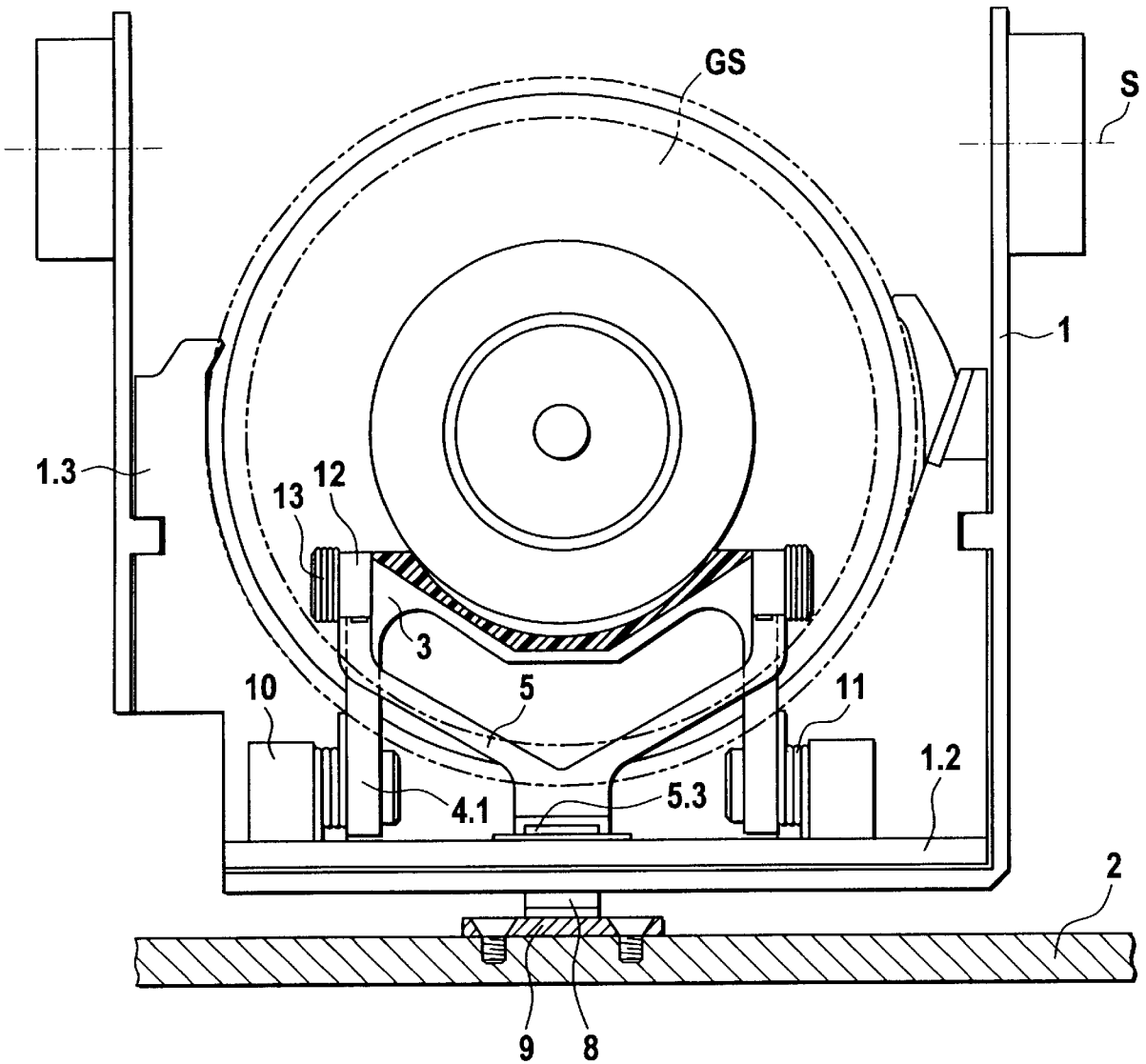
FIG. 4 is a front view of the readiness tray (as viewed from the left in FIG. 1)
Figure 5:
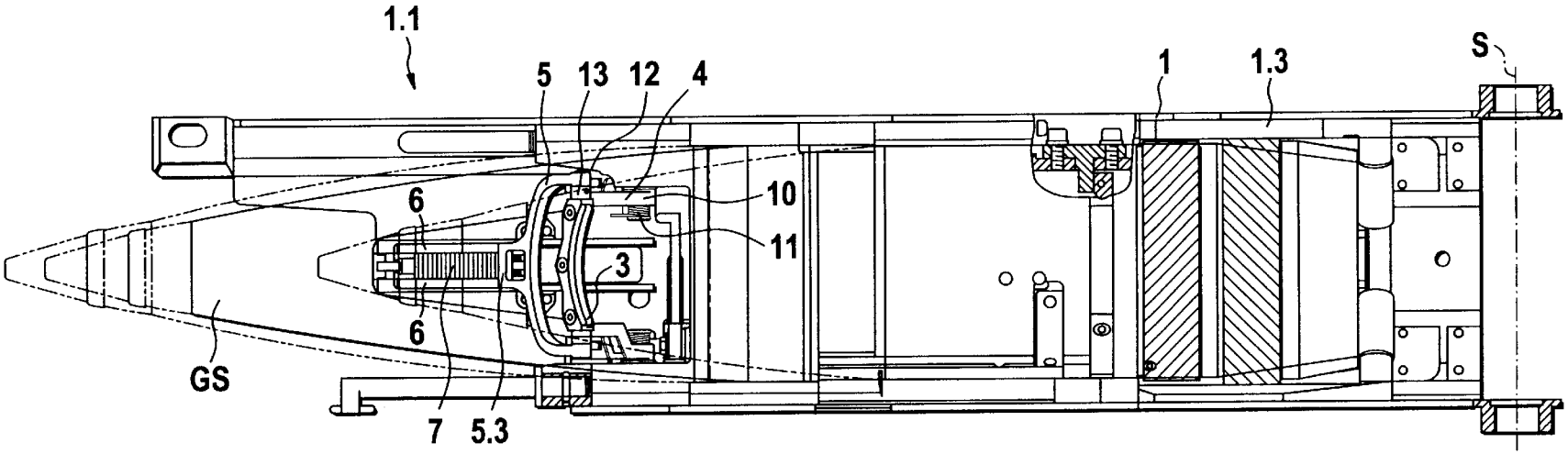
FIG. 5 is a top view of the readiness tray illustrated in FIGS. 1 through 4.

A mechanism for axially braking and fixing a shell laid in readiness tray 1 is mounted on the tray. For this purpose the mechanism includes a shell support 3 at the end 1.1 of the tray near the point of the shell. When laid in readiness tray 1, a shell GS will come to rest on shell support 3 and be supported in the vicinity of its ogive. This feature will prevent the shell from sliding and tipping farther forward. Shell support 3 is mounted on an articulated supporting-lever rod that includes an initial supporting lever 4. As will be evident from FIGS. 4 and 5, lever 4 is bifurcated and articulated at its two rear ends 4.1 to the base 1.2 of readiness tray 1 by way of blocks 10. Upright springs 11 in the vicinity of the articulation subject supporting lever 4 to a force that tends to lift its free end 4.2, the end that shell support 3 is attached to. First supporting lever 4 accordingly extends up and parallel to the direction that shell GS lies in. The articulated-lever system also includes another supporting lever 5 articulated at one end 5.1 to the free end 4.2 of first supporting lever 4. Second supporting lever 5 is also bifurcated. Upright springs 13 are articulated to links 12 and tend to force the other end 5.2 of second supporting lever 5 down toward the base 1.2 of readiness tray 1. Second supporting lever 5 accordingly extends down and parallel to the direction that shell GS lies in. At the lower end 5.2, of second supporting lever 5 is a pawl 5.3 that rests on two separated and axially extending glideways 6. Pawl 5.3 engages a notched rod 7 between glideways 6 as long as notched rod 7 is above them. The engagement of pawl 5.3 in notched rod 7 locks the articulated-lever system, preventing shell support 3 from descending any further even while a shell GS is being laid in the tray. To allow control of the upward and downward motions of notched rod 7, it is mounted on a skate 8 that ascends and descends in a cutout in the base 1.2 of readiness tray 1 and is subject to the downward force of compression springs 14 such that its lower side, depending on the position of readiness tray 1 on the forwarding path's baseplate 2, either rests on a control strip 9 with an entrance ramp 9.1 and an exit ramp 9.2 (FIG. 1) or, once readiness tray 1 has stopped moving, directly on baseplate 2. As readiness tray 1 travels along baseplate 2, skate 8 slides over the entrance ramp 9.1 of control strip 9 and is accordingly raised against the force of springs 14. Consequently, notched rod 7 will ascend between glideways 6, and second supporting lever pawl 5.3 will engage notched rod 7. Depending on the size of the shell lying in the tray, accordingly, the articulated-lever system will be locked into a position prescribed by the shell's height. The continuous lines in FIGS. 1 and 2 illustrate supporting levers 4 and 5 and shell support 3 raised, and the broken lines show them in a lower position associated with a larger shell. The accordingly locked articulated-lever system fixes shell support 3 in position, and the shell GS lying in the tray is prevented from sliding and tilting farther forward axially.

Mounted on the bottom of skate 8 is a blade 8.1 that can be pressed against the skate in opposition to the force of a compression spring 8.2. The characteristics of springs 8.2 and 14 are proportioned to ensure that skate 8 will glide smoothly over control strip 9 and its ramps 9.1 and 9.2.

Figure 3:
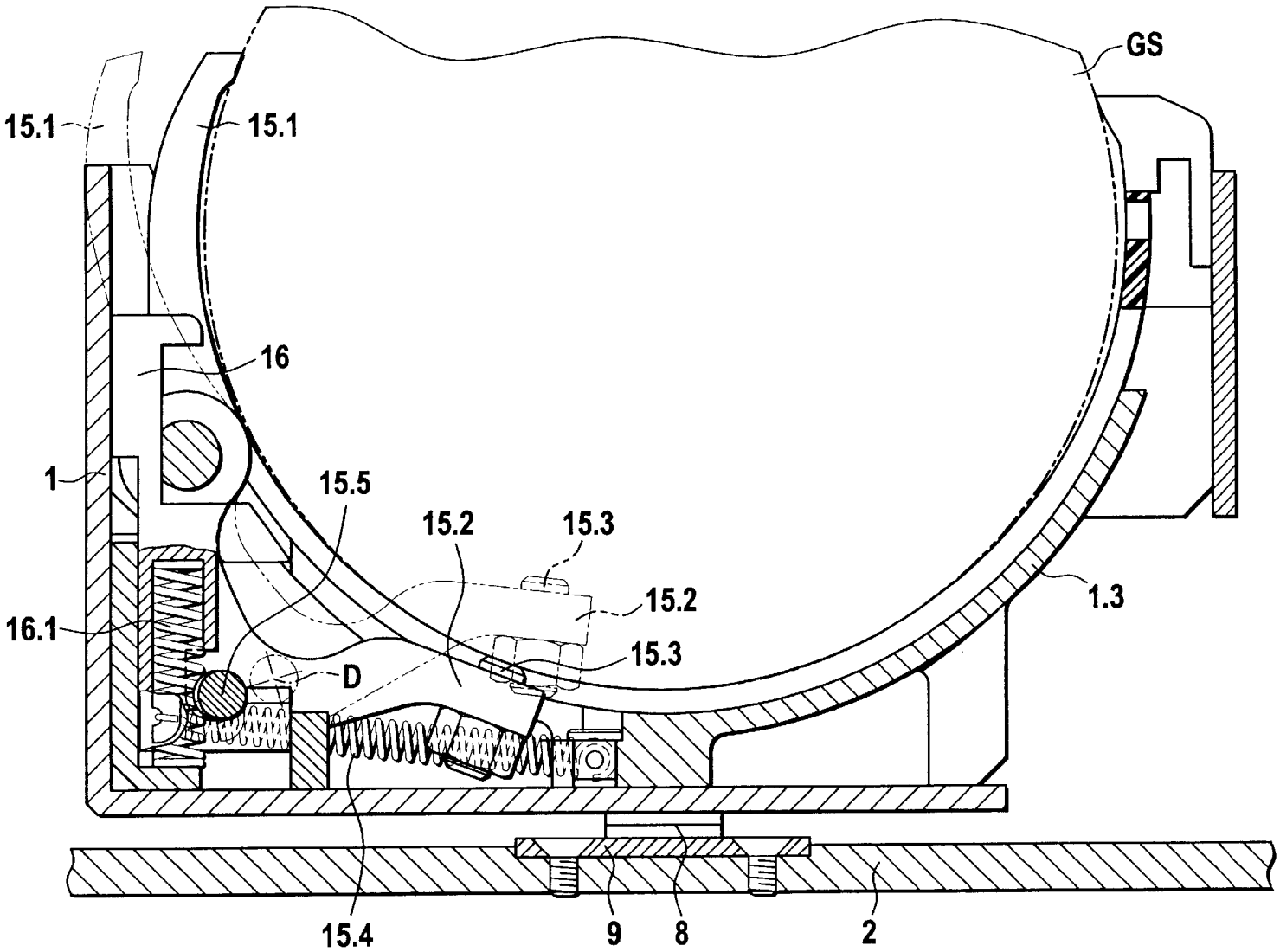
FIG. 3 is a section through the readiness tray in a vertical plane along the line III—III in FIG. 1.

The readiness tray illustrated in FIGS. 1 through 6 is also provided with a mechanism for radially securing a shell lying therein. This mechanism includes a lever with two arms 15.1 and 15.2 (FIG. 3) that pivots around an axial axis D. Arm 15.1 embraces the shell GS in readiness tray 1 around the part of its circumference facing the open side of the tray. One end of the second arm 15.2 of the lever is provided with a setscrew 15.3 and lies opposite an opening in the base of the interior 1.3 of readiness tray 1. The lever is forced by a spring 15.4 in a direction that ensures that, when there is no shell in the readiness tray, second arm 15.2 and setscrew 15.3 will extend into the tray's interior 1.3. This state is represented in FIG. 3 by the dot-and-dash lines. The weight of shell GS against setscrew 15.3 will shift the lever to the extent that first arm 15.1 will pivot in, securing shell GS, and will be automatically locked in this state. This is ensured by a bolt 15.5 that rotates in bolt 15.5 and can be adjusted by a cam, that-varies the tension against the surface of the shell. As the lever shifts, bolt 15.5 will snap into a cutout in a release slide 16.Actuation of release slide 16 against the force of a spring 16.1 will unlock the system, allowing shell GS to be removed from readiness tray 1.

What is claimed is:

1. A device for forwarding large-caliber shells to a heavy weapon, wherein the shells are laid in a readiness tray by a shell transporter provided with a shell grip, wherein the readiness tray can be displaced horizontally along a forwarding path and pivoted up around a horizontal axis at the end of the path into an essentially vertical attitude, wherein the shell is transferred from the readiness tray to a loading tray positioned on the free end of a shell-release arm that pivots around the weapon's trunnions, characterized by a mechanism on the readiness tray (1) that axially brakes and fixes any shell (GS) laid therein and by a shell support (3) at the end (1.1) of the readiness tray associated with the point of the shell that supports the shell therein in the vicinity of its ogive, whereby the shell support is mounted on a supporting-lever rod (4 & 5) that can be lowered against the force of a spring, its descent being blocked by a blocking mechanism during a prescribed length of the readiness tray's travel along its forwarding path (2), and wherein said supporting-lever rod is in the form of an articulated-lever system that comprises two supporting levers, the first said lever (4) able to pivot on the base of the readiness tray (1) and the second lever (5) being articulated at one end (5.1) to the free end (4.2) of the first supporting lever, whereby the first supporting lever slopes up in the direction the shell lies in, with the shell support (3) mounted on its free end, and whereby the second supporting lever slopes down in the direction the shell lies in, with its other end (5.2) attached to the base of the readiness tray (1) by way of the blocking mechanism and sliding axially.

2. The device of claim 1, further comprising an armored howitzer in which said device for forwarding large-caliber shells to a heavy weapon is utilized.

3. The device of claim 1, wherein the blocking mechanism includes a pawl (5.3) at the other end (5.2) of the second supporting lever (5) and resting on two axially separated glideways (6), wherein a notched rod (7) between the glideways ascends above and descends below them, and wherein, when the rod is below the glideways, the pawl slides along them and, when the rod is above them, the pawl engages the rod, locking the articulated-lever system, the rod's position being controlled by the motion of the readiness tray (1).

4. The device of claim 3, wherein the notched rod (7) is mounted on a skate (8) that ascends and descends in a cutout in the base (1.2) of the readiness tray (1), and can be displaced axially along with the tray, whereby, as the readiness tray moves axially, the lower surface of the skate moves onto and off a stationary control strip (9), accordingly being raised and lowered against the force of a resilient component (14).

5. The device of claim 4, wherein the skate (8) rests on the control strip (9) by way of a blade (8.1) that can be forced against the skate in opposition to the force of compression spring (8.2).

6. The device of claim 1, wherein an upward force exerted on the articulated-lever system (4 & 5) depends on the action of resilient components (11 & 13) in the vicinity of the system's articulations (10 & 12).

7. The device of claims 1, wherein said mechanism on the readiness tray (1) radially secures a shell lying in the tray when the tray pivots up, and wherein said mechanism comprises a lever with two arms that pivots around a horizontal axis (D), the first said arm (15.1) able to pivot into a position to engage a part of the circumference of the shell (GS) that faces the open side of the tray and at least one end (15.3) of the second arm (15.2) able to pivot into the tray through an opening in its base (15.3) subject to the force of a spring (15.4), allowing the weight of the shell to force the second arm out of the opening, the first arm accordingly being able to pivot into a position to secure the shell (GS) and to be locked into that position by a locking mechanism (15.5 & 16) that can be disengaged.

* * * * *